US007168600B2

(12) United States Patent
Hwang

(10) Patent No.: US 7,168,600 B2
(45) Date of Patent: Jan. 30, 2007

(54) BABY CARRIER

(76) Inventor: Choon Hwa Hwang, 991-10 Hogae-1-dong, Donganku, Anyang, Kyungkido (KR)

( * ) Notice: Subject to any disclaimer, the term of this patent is extended or adjusted under 35 U.S.C. 154(b) by 494 days.

(21) Appl. No.: 10/770,609

(22) Filed: Feb. 3, 2004

(65) Prior Publication Data

US 2004/0155078 A1 Aug. 12, 2004

Related U.S. Application Data

(63) Continuation-in-part of application No. 09/910,529, filed on Jul. 20, 2001, now abandoned.

(51) Int. Cl.
*A45F 4/02* (2006.01)

(52) U.S. Cl. ..... 224/155; 224/153; 224/160

(58) Field of Classification Search ..... 224/160, 224/153, 155, 577, 571, 158, 159, 627, 259
See application file for complete search history.

(56) References Cited

U.S. PATENT DOCUMENTS 3,297,119 A * 1/1967 Viol ..... 190/8
D266,800 S 11/1982 Kula et al. ..... D3/214
4,579,264 A * 4/1986 Napolitano ..... 224/160
5,678,739 A 10/1997 Darling et al. ..... 224/158
5,791,535 A 8/1998 Roan et al. ..... 224/153
5,813,580 A * 9/1998 Fair ..... 224/160
6,045,018 A 4/2000 Onishi ..... 224/158

* cited by examiner

*Primary Examiner*—Nathan J. Newhouse
*Assistant Examiner*—Jack H. Morgan
(74) *Attorney, Agent, or Firm*—John K. Park; Park Law Firm

(57) ABSTRACT

A baby carrier comprises a wrapper partitioned to a front portion and a rear portion, front portion having a back support to support the back of a baby when needed and a hip sheet extending from the back support, the rear portion having a bottom sheet extending from the hip sheet and a rear sheet extending from the hip sheet, auxiliary supports each connected to the bottom sheet to support the thighs of the baby when needed, and shoulder straps connecting the back support to the auxiliary supports to hook the connected shoulder straps on the shoulders of a baby caretaker when needed. The hip sheet is foldable over on the bottom sheet so as to allow the baby to sit on the hip sheet detachably layered on the bottom sheet while being supported by the auxiliary supports.

6 Claims, 6 Drawing Sheets

BABY CARRIER

This is a continuation-in-part application of Ser. No. 09/910,529 filed Jul. 20, 2001, now abandoned.

BACKGROUND OF THE INVENTION

The present invention relates to a baby carrier, and more particularly, to a baby carrier which enables a baby to be taken on a baby caretaker's back such as a baby mother's back at the posture of the baby sitting on a chair, to thereby reduce burdens of the baby caretaker such as the mother of the baby.

In general, most of baby carriers which are used for taking a baby on a baby caretaker's back includes a cover sheet wrapping both bodies of a baby and a baby caretaker, and a binding strap wound round the cover sheet, for providing a binding force for binding the cover sheet.

Such a conventional baby carrier enables a baby caretaker to take a baby on his or her back comfortably with a comparatively small force, since the baby adheres to the baby caretaker. However, since the baby enclosed with the cover sheet is bound on the baby caretaker's waist with the binding strap in use, it is not convenient for the baby caretaker to use the baby carrier. Further, the baby can fall down from the baby caretaker's back at an instant time when the baby is taken on the baby caretaker's back.

A baby carrier shown in FIG. 11 and disclosed in Korean Patent Laid-open Publication No. 99-73529 includes a wrapper 100 capable of enclosing a baby, a hip supporting belt (not shown) whose both ends are combined with the wrapper 100, to thereby support the hip of the baby, and shoulder belts 300 which are respectively provided on both ends of the wrapper 100, and which are bound mutually by a binder 310. In particular, the wrapper 100 includes an elastic supporter 110 for elastically supporting the neck of the baby to smoothly support the neck of the baby. Also, a saddle pants portion 120 having flexibility is provided in the inner surface of the wrapper 100 so that the baby can be stably supported.

However, in the case of the above conventional baby carrier, the weight of the baby is concentrated into the hip support belt, and the saddle pants portion presses over the thighs and the waist of the baby, to thereby have the baby feel uncomfortable. Further, when the baby is inserted into the saddle pants portion, the legs of the baby should be widened. In addition, a variety of articles to be carried basically by a baby caretaker should be carried separately.

Korean patent laid-open publication Nos. 97-61142 and 99-1143, disclose a technology entitled "Waist bag combined with baby holder," respectively in which a baby is sat in the body of a baby holder combined with a waist bag, and simultaneously a simple article can be accommodated.

However, in the case of the "waist bag combined with baby holder," since a baby caretaker is somewhat distant from a baby, the baby caretaker should burden a heavy workload. Also, since the baby caretaker should always embrace a baby, the baby caretaker is easy to be tired when he or she is out or works for a long time. Further, since the weight of the baby is concentrated on the inside of the thighs of the baby, the baby may feel uncomfortable.

SUMMARY OF THE INVENTION

To solve the above problems, it is an object of the present invention to provide a baby carrier that is designed to reduce the burden of the weight of a baby.

It is another object of the present invention to provide a baby carrier that enables a baby to sit therein psychologically stable and comfortably due to a structure that a baby adheres closely to a baby caretaker.

It is still another object of the present invention to provide a baby carrier that can be used as a knapsack when the baby carrier is not used for taking a baby on a baby caretaker's back, and simple articles can be accommodated even when the baby carrier is used for taking a baby on a baby caretaker's back.

To accomplish these and other objects, a baby carrier according to the present invention comprises a wrapper partitioned to a front portion and a rear portion, wherein the front portion has a back support to support the back of a baby when needed and a hip sheet extending from the back support. The rear portion has a bottom sheet extending from the hip sheet and a rear sheet extending from the hip sheet where auxiliary supports are each connected to the bottom sheet to support the thighs of the baby when needed. The baby carrier further comprises shoulder straps connecting the back support to the auxiliary supports to hook the connected shoulder straps on the shoulders of a baby caretaker when needed, where the hip sheet is foldable over on the bottom sheet so as to allow the baby to sit on the hip sheet detachably layered on the bottom sheet while being supported by the auxiliary supports.

Advantages of the present invention are numerous. First, at the state when a baby is strapped to a baby caretaker's back, the tensile strength works on the hip sheet and the back support being supported by the shoulder straps and the auxiliary supports to thereby form a catenary's curve in the hip sheet and the back support of the front portion of the wrapper. Thus, the weight of the baby is distributed uniformly, and the baby adheres closely to the baby caretaker's back. As a result, a coupling moment occurring when the baby caretaker is at work becomes smaller, which enables the baby caretaker to consume a much smaller amount of force and burden when he or she takes the baby on his or her back. Second, the structure that the baby adheres closely to the baby caretaker's back provides the baby with a sense of psychological stability. Third, the baby carrier can be used as a knapsack when the baby carrier is not used for taking a baby on a baby caretaker's back.

Fourth, in contrast to the conventional baby carrier requiring that the legs of the baby are widened to enable a baby caretaker to insert the baby into a saddle pants portion, the baby carrier according to the present invention enables a baby caretaker to easily hook the shoulder straps of the baby carrier on his or her shoulder after a baby is loaded or positioned in the hip sheet and the back support of the front portion of the wrapper at the state where the wrapper is unfolded in a sack format, with a result that the baby can be easily taken on the baby caretaker's back.

Finally, the baby carrier according to the present invention can be applied depending upon the body shape of a baby by adjusting adjustment straps.

BRIEF DESCRIPTION OF THE DRAWINGS

The above objects and other advantages of the present invention will become more apparent by describing the preferred embodiments thereof in more detail with reference to the accompanying drawings in which.

DETAILED DESCRIPTION OF THE INVENTION

Figure 1:
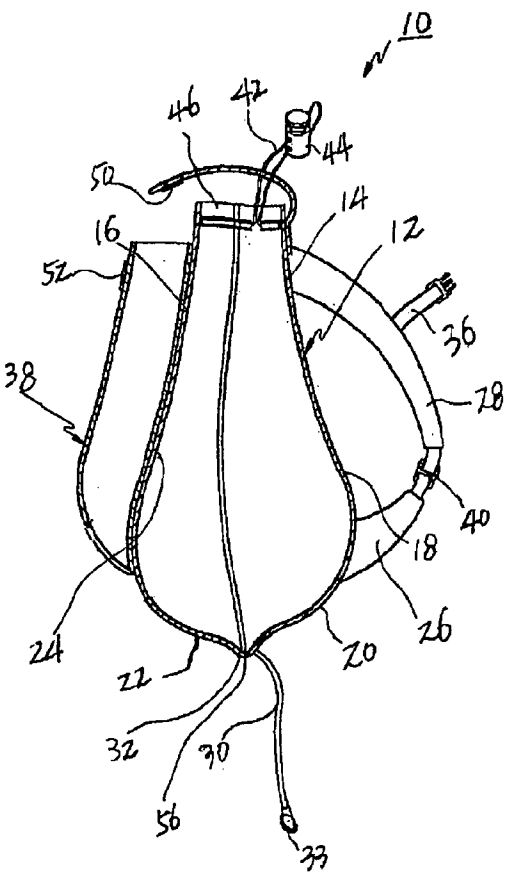
FIG. 1 is a view showing a baby carrier according to the present invention wherein the baby carrier serves as a sack.
Figure 2:
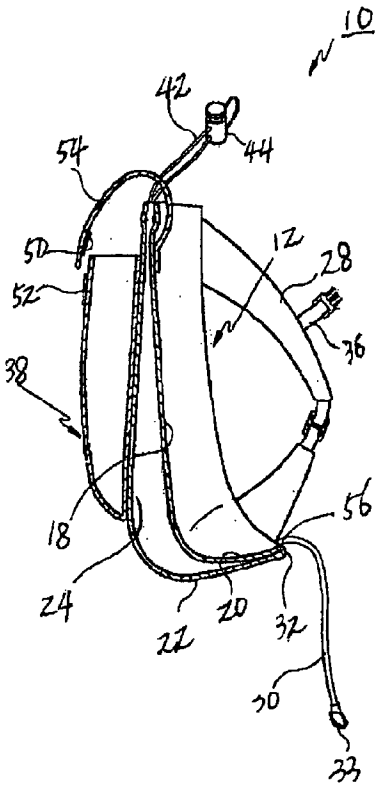
FIGS. 2 and 3 are views each showing conversion from a sack to the baby carrier.
Figure 3:
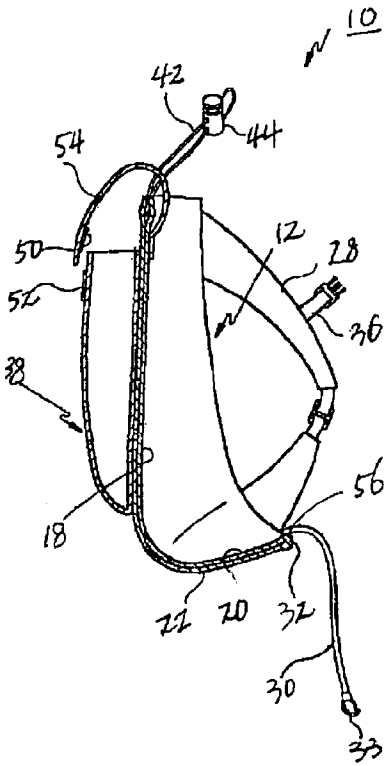

As shown in FIGS. 1–3, a baby carrier 10 according to the present invention comprises a wrapper 12 partitioned to a front portion 14 and a rear portion 16. The front portion 14 has a back support 18 to support the back of a baby when needed and a hip sheet 20 extending downwardly from the back support 18. The rear portion 16 has a bottom sheet 22 extending from the hip sheet 20. The rear portion 16 of the wrapper 12 also includes a rear sheet 24 extending upwardly from the bottom sheet 22. The wrapper 12 may be provided in form of a sack and substantially sagged around the hip sheet 20 and the bottom sheet 22.

As further shown in FIGS. 4–6 and 8–10, auxiliary supports 26 are each connected to the bottom sheet 22 to support the thighs of the baby when needed. Also, shoulder straps 28 are provided to connect the back support 14 to the auxiliary supports 26 to become hooked on the shoulders of a baby caretaker when needed. In this construction, the hip sheet 20 is foldable over on the bottom sheet 22 so as to allow the baby to sit on the hip sheet 20 which is detachably layered on the bottom sheet 22. Here, the bottom sheet 22 is supported by the auxiliary supports 26.

Figure 4:
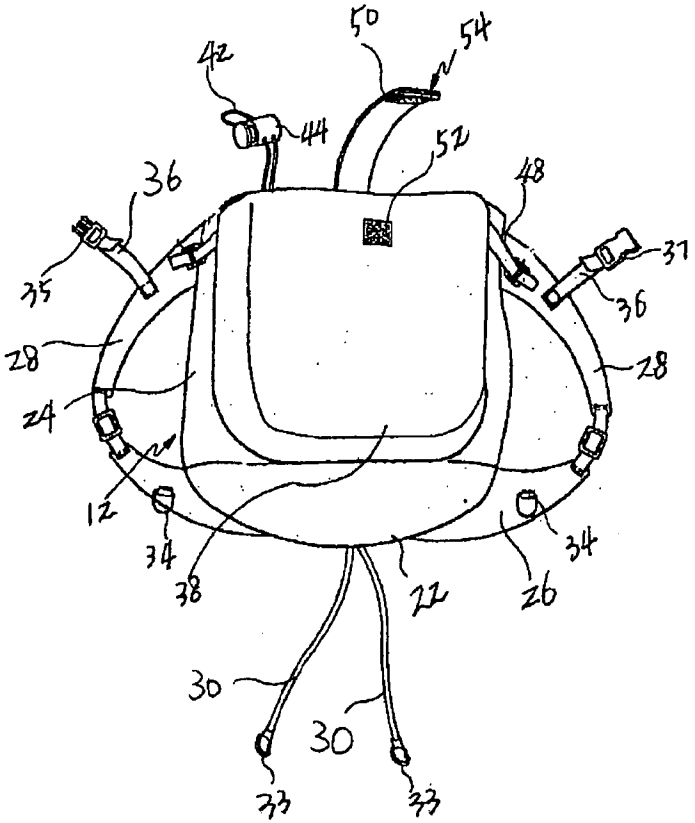

The baby carrier 10 further comprises safety belts 30 connected to a lower-center of the wrapper 32. The safety belts 30 are detachably connected over the thighs of the baby to the auxiliary supports 26. Specifically, as shown in FIG. 4, the safety belts 30 are fastened to hooks 34 of the auxiliary supports 26. Selectively, connection belts 36 may be provided to connect the shoulder straps 28 in a horizontal tying format. A pocket 38 is preferably attached to the rear support 16, for example, to accommodate nursing bottles and diapers. In a preferred version, the auxiliary supports 26 are connected by gap adjustment straps 40 to the shoulder straps 28.

Figure 7:
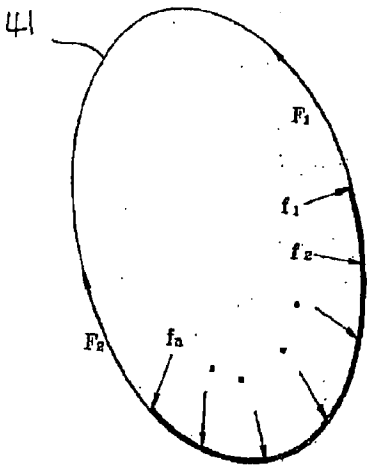
FIG. 7 is a view showing efficiency of the baby carrying mechanism of the present invention.
Figure 6:
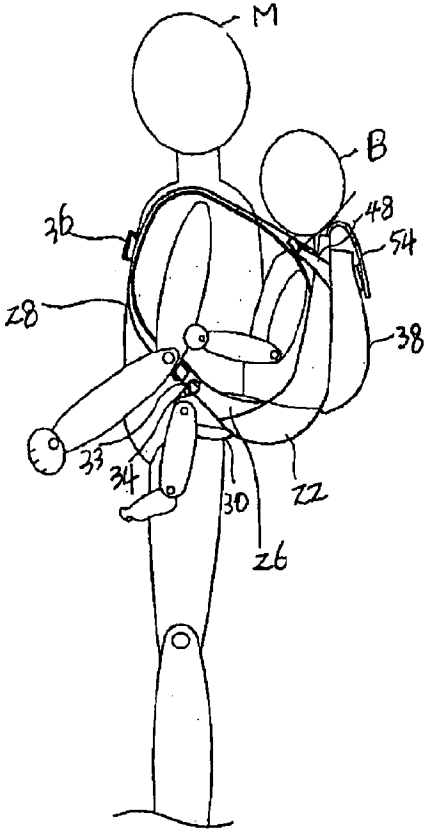
FIG. 6 is a view showing a caretaker carrying a baby using the baby carrier.
Figure 8:
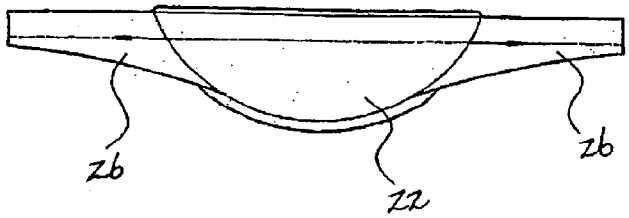
FIG. 8 is a bottom view showing connection of auxiliary supports to a bottom sheet of the baby carrier.

Referring to FIGS. 6 and 7, when the baby caretaker M wears the baby carrier 10, the weight of the baby works along the wide curve f1–fn of the oval loop 41 reflecting the imaginary closed line formed by the back support 18, the hip sheet 20, the shoulder straps 28 and the auxiliary supports 26 of the baby carrier 10. The loads indicated by f1–fn with regard to the baby's weight are transferred to the shoulder strap 28 as external forces F1 and F2. As a result, an equilibrium state is maintained and enables the baby B to closely adhere to the baby caretaker M. As the baby B closely adheres to the baby caretaker M, the distance between the load center of the baby B and the baby caretaker M becomes relatively short. Accordingly, since a coupling moment becomes small, external forces F1 and F2 burdened by the baby caretaker M become small. Thus, since a much smaller force is consumed during the time when the baby caretaker M works on caretaking the baby B using the baby carrier 10, the fatigue of the baby caretaker M is substantially reduced. Also, since the baby B adheres to the baby caretaker M, the baby B becomes psychologically stable.

The baby carrier 10 becomes a state where a baby can be taken on a baby caretaker's back when the front portion 14 of the wrapper 12 is pushed in toward the rear portion 16 of the wrapper 12. Whereas, in case that the baby carrier 10 is not used for caretaking a baby, the front portion 14 of the wrapper 12 may be restored to use the wrapper 12 as a container or a sack.

Figure 5:
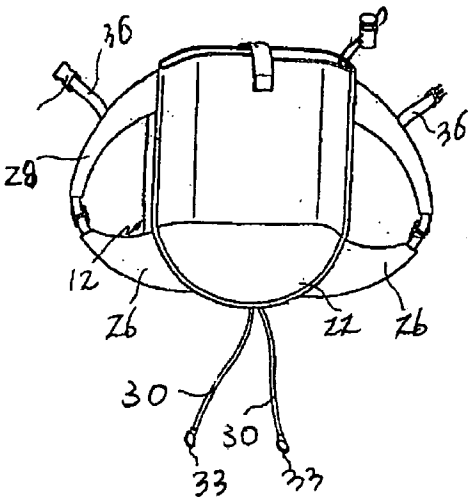
FIGS. 4 and 5 are rear views of the baby carrier.

As further shown in FIGS. 4 and 5, the safety belts 30 may be sewed on the bottom sheet 22. The safety belts 30 pass through between the legs of the baby and the hooks 33 of the safety belt 30 are combined with rings 34 provided on the auxiliary supports 26 to thereby prevent the baby from falling down from the baby carrier 10.

Hooks 33 are formed in the respective ends of the safety belt 30, which are respectively connected to reception hooks 34. For the connection belts 36, a male holder 35 is formed in each one end thereof and a female holder 37 is formed in the other end thereof. Accordingly, the connection belts 36 are respectively connected to the shoulder straps 28. In this case, the shoulder straps 28 are prevented from slipping down from either shoulder of the baby caretaker.

Meanwhile, shoulder straps 28 are preferably constituted in the same directions as those of forces F1 and F2 in FIG. 7, working in the transverse direction with respect to the bottom sheet 22 when a baby caretaker takes a baby on his or her back. In this case, since the weight of the baby is distributed on the hip and bottom sheets 20, 22 uniformly, a baby caretaker feels relatively less burdened during the time when he or she takes a baby on his or her back.

A tightening strap 42 is releasably attached the upper side of the wrapper 12. An adjustment unit 44 is connected to the tightening strap 42. Thus, when the tightening strap 42 is tightened or released, the top opening 46 of the wrapper 12 can be opened and closed.

Also, adjustment belts 48 are provided to controllably fasten the pocket 38 to the shoulder straps 28. In this case, the adjustment belts 48 can be adjusted in length and the wrapper 12 can also be adjusted depending upon the body shape of a baby. Accordingly, in the case that a baby is taken on a baby caretaker's back, the baby can adhere mutually more closely to the baby caretaker.

A hook-shaped tape 50 is attached on a belt 54 sewed in the upper-center of the back support 14, and a loop-shaped pile 52 is attached on the pocket 38 to which the hook-shaped magic tape 50 is attached.

The wrapper 12 of the baby carrier 10 may be inflated through the top opening 46 to turn the baby carrier 10 to a sack for material carriage.

The front portion 14 including the back support 18 and the hip sheet 20 can be pushed (folded) into the rear portion 16 of the wrapper 12 along the folding line 56 partitioning the front portion 14 from the rear portion 16. The folding line 56 serves to facilitate the conversion of the baby carrier 10 from a sack format to a baby carrier format and vise versa. When the front portion 14 of the wrapper 12 is pushed toward the pocket 38 and double-layered with the rear portion 16, the baby is allowed comfortably sit on the hip sheet 20 with the baby's back rested along the back support 18 of the front portion 14 of the wrapper 12.

When the baby is seated on the hip sheet 20, the hip sheet 20 becomes lengthened due to the weight of the baby, thereby forming a catenary's curve which serves to evenly distribute the load of the baby while supporting the thighs of the baby. At this time, the hip sheet 20 is preferably formed in a concave structure into which a baby can be stably loaded.

Figure 9:
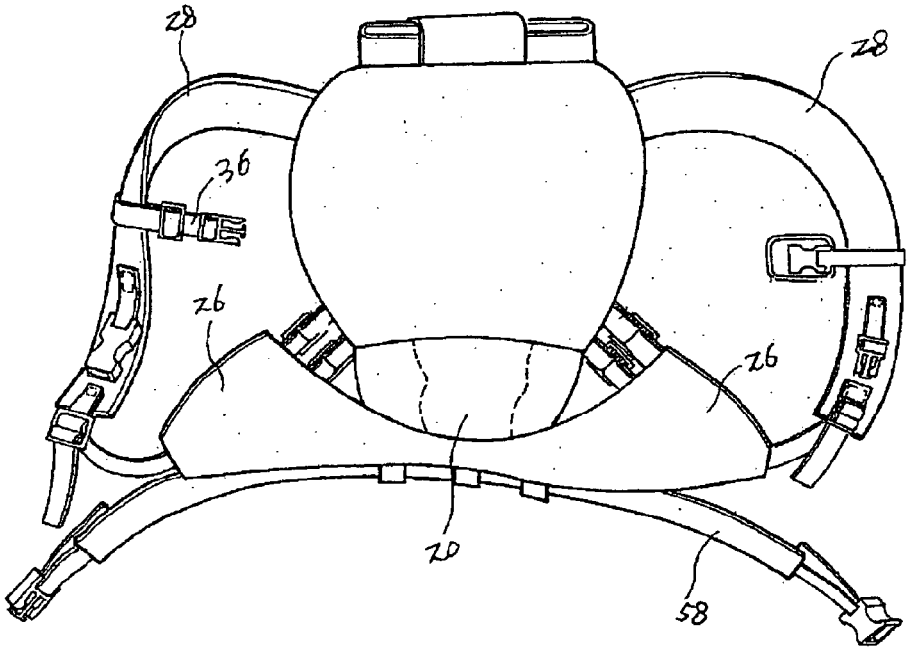
FIG. 9 is a view showing a safety mechanism of the baby carrier.
Figure 10:
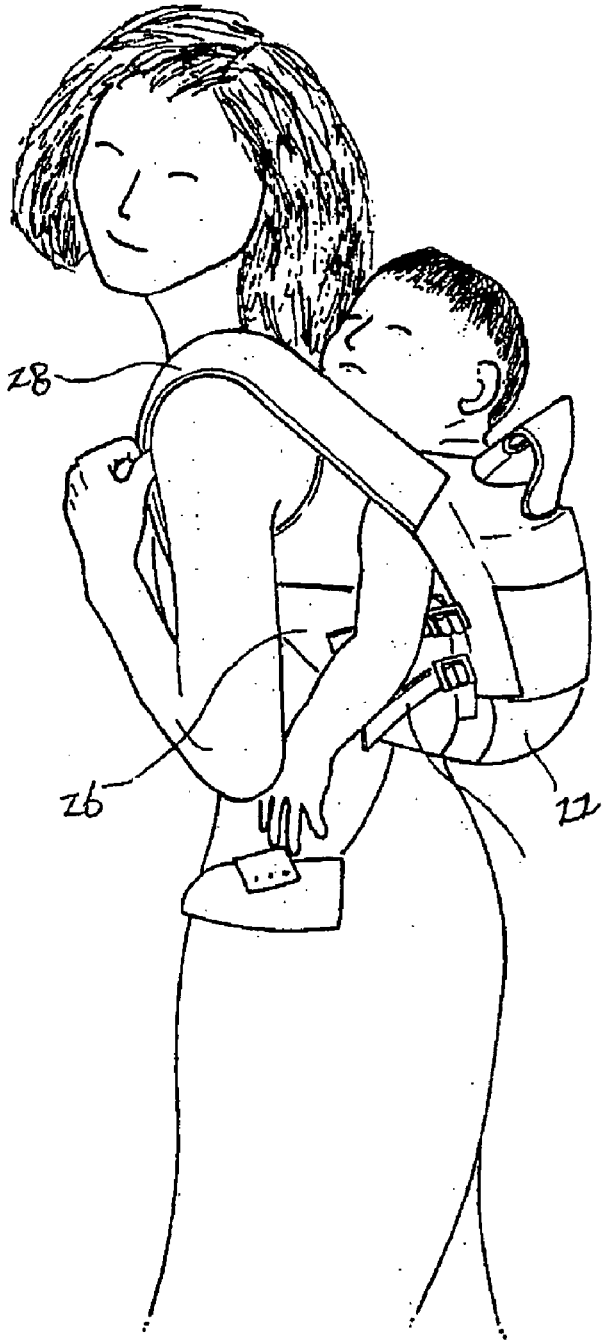
FIG. 10 is a model view showing an actual use of the baby carrier.
Figure 11:
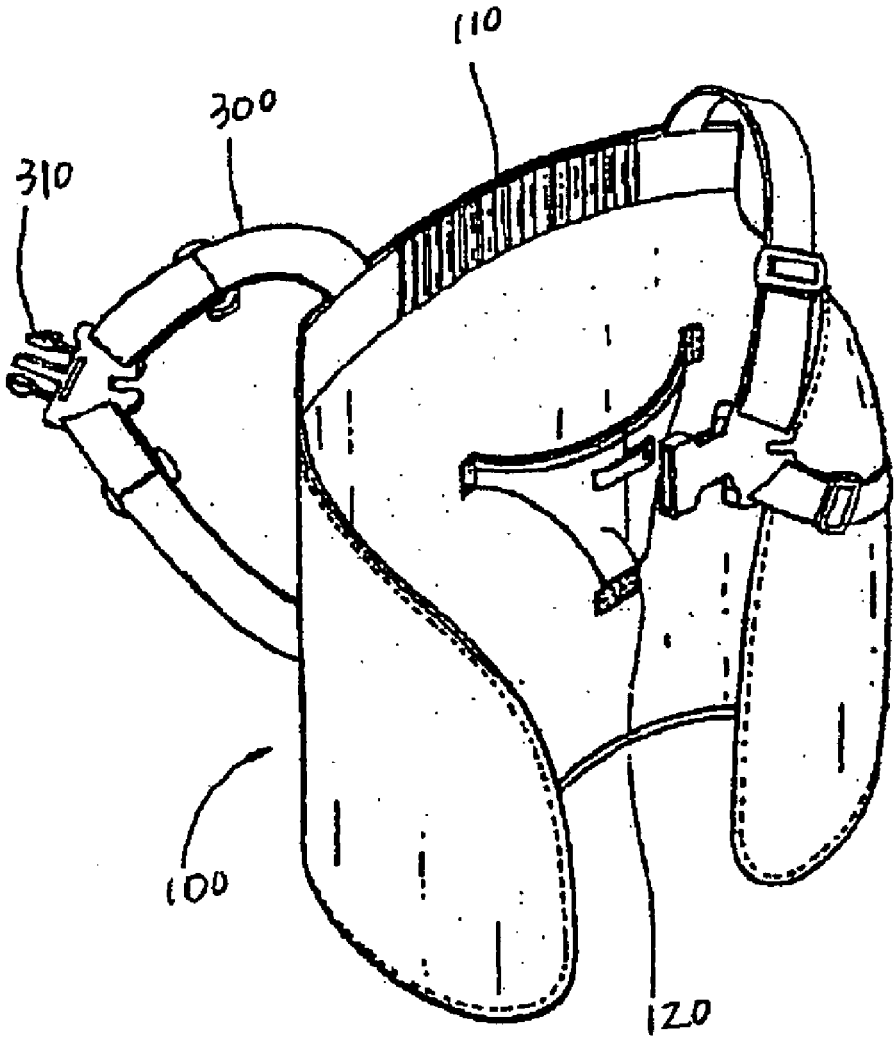
Fig. 11 Prior Art
FIG. 11 is a view showing a conventional art.

For a better performance, as shown in FIG. 9, a waist belt 58 may be selectively connected to the auxiliary supports 26. The waist belt 58 is worn on the waist of the baby caretaker to prevent unwanted movement of the baby carrier 10 so that the baby caretaker can be freely at work even when he or she wears the baby carrier 10.

As described above, the baby carrier 10 according to the present invention has the following merits and advantages.

First, at the state when a baby is strapped to a baby caretaker's back, the tensile strength works on the hip sheet 20 and the back support 18 being supported by the shoulder straps 28 and the auxiliary supports 26 to thereby form a catenary's curve in the hip sheet 20 and the back support 18 of the front portion 14 of the wrapper 12. Thus, the weight of the baby is distributed uniformly, and the baby adheres closely to the baby caretaker's back. As a result, a coupling moment occurring when the baby caretaker is at work becomes smaller, which enables the baby caretaker to consume a much smaller amount of force and burden when he or she takes the baby on his or her back.

Second, the structure that the baby adheres closely to the baby caretaker's back provides the baby with a sense of psychological stability.

Third, the baby carrier 10 can be used as a knapsack when the baby carrier is not used for taking a baby on a baby caretaker's back.

Fourth, in contrast to the conventional baby carrier requiring that the legs of the baby are widened to enable a baby caretaker to insert the baby into a saddle pants portion, the baby carrier 10 according to the present invention enables a baby caretaker to easily hook the shoulder straps 28 of the baby carrier 10 on his or her shoulder after a baby is loaded or positioned in the hip sheet 20 and the back support 18 of the front portion 14 of the wrapper 12 at the state where the wrapper 12 is unfolded in a sack format, with a result that the baby can be easily taken on the baby caretaker's back.

Finally, the baby carrier according to the present invention can be applied depending upon the body shape of a baby by adjusting adjustment straps.

The present invention is not limited to the above embodiments. It is apparent to those who are skilled in the art that there are many modifications within the technical scope and spirit of the invention.

What is claimed is:

1. A baby carrier comprising:

a wrapper having a front portion and a rear portion, wherein the front portion has a back support to support the back of a baby when needed and a hip sheet extending from the back support, wherein the rear portion has a bottom sheet extending from the hip sheet and a rear sheet extending from the hip sheet, wherein auxiliary supports are each connected to the bottom sheet to support the thighs of the baby when needed; and shoulder straps connecting the back support to the auxiliary supports to become hooked on the shoulders of a baby caretaker when needed, wherein the hip sheet is foldable over on the bottom sheet so as to allow the baby to sit on the hip sheet detachably layered on the bottom sheet supported by the auxiliary supports.

2. The baby carrier of claim 1 further comprising safety belts connected to a lower-center of the wrapper, wherein the safety belts are detachably connected over the thighs of the baby to the auxiliary supports.

3. The baby carrier of claim 1 further comprising connection belts connecting the shoulder straps.

4. The baby carrier of claim 1 further comprising a pocket attached to the rear sheet.

5. The baby carrier of claim 1 wherein the auxiliary supports are connected by gap adjustment straps to the shoulder straps.

6. The baby carrier of claim 1 wherein the wrapper is formed in a sack.

* * * * *